US005611891A

United States Patent [19]

Hundley, III

[11] Patent Number: 5,611,891

[45] Date of Patent: Mar. 18, 1997

[54] SYSTEM AND METHOD FOR CONTROLLING PAPERMAKING STOCK CONSISTENCY

[75] Inventor: Raymond E. Hundley, III, Hot Springs, Va.

[73] Assignee: Westvaco Corporation, New York, N.Y.

[21] Appl. No.: 569,589

[22] Filed: Dec. 8, 1995

[51] Int. Cl.[6] ..... D21F 1/08; D21F 1/06

[52] U.S. Cl. ..... 162/198; 162/258; 162/259; 162/253; 162/DIG. 11

[58] Field of Search ..... 162/198, 252, 162/253, 258, 259, DIG. 10, DIG. 11

[56] References Cited

U.S. PATENT DOCUMENTS

| | | | |
|---|---|---|---|
| 3,562,104 | 2/1971 | Taylor | 162/253 |
| 3,619,360 | 11/1971 | Persik, Jr. | 162/258 |
| 3,634,187 | 1/1972 | Chari et al. | 162/198 |
| 3,779,863 | 12/1973 | Wahren | 162/253 |
| 3,886,036 | 5/1975 | Dahlin | 162/198 |
| 3,926,719 | 12/1975 | Spitz | 162/253 |
| 3,930,934 | 1/1976 | Spitz | 162/198 |
| 3,962,581 | 6/1976 | Zimmerman | 250/341 |
| 3,981,767 | 9/1976 | Al-Shaikh | 162/198 |
| 4,053,353 | 10/1977 | Leffler | 162/198 |
| 4,161,205 | 7/1979 | Justus | 162/133 |
| 4,415,408 | 11/1983 | Greey | 162/198 |
| 4,582,568 | 4/1986 | Iyengar | 162/258 |
| 4,680,957 | 7/1987 | Dodd | 73/55 |
| 5,076,890 | 12/1991 | Balembois | 162/198 |
| 5,300,193 | 4/1994 | Rule, Jr. et al. | 162/198 |

OTHER PUBLICATIONS

Torborg, "Selection of consistency sensor requires knowledge of all options", Pulp & Paper, Jun. 1987, pp. 109–113.

Thechnical div. Process Control and System Design Work. Group, "Thick–stock consitency transmitters and their use", Paper Tech. & Ind., Jan. 1978, pp. 11–14.

Gaigalas, "A new approach to the measurement of pulp consistency", Tappi Journal, Jul. 1986, p. 103.

Fisher–Rosemount Systems, RTM/1 Intelligent Sensor, "Measure the key process variables you thought were unmeasurable, " Form 8207 Fisher Controls International, Inc. and Rosemount Inc., 1993.

*Primary Examiner*—Donald E. Czaja
*Assistant Examiner*—Jose A. Fortuna
*Attorney, Agent, or Firm*—J. R. McDaniel; R. L. Schmalz

[57] ABSTRACT

This invention relates to the measurement and control of consistency in an aqueous flow stream, as it leaves a stage (i.e. Bleaching Stage) of the papermaking process. More particularly, the present invention relates to the measurement used for control of wood fiber and suspended solids in a papermaking pulp stock flow stream.

8 Claims, 4 Drawing Sheets

SYSTEM AND METHOD FOR CONTROLLING PAPERMAKING STOCK CONSISTENCY

BACKGROUND OF THE INVENTION

1. Field of the Invention

This invention relates to the measurement and control of consistency in an aqueous flow stream, as it leaves a stage (i.e. Bleaching Stage) of the papermaking process. More particularly, the present invention relates to the measurement used for control of wood fiber and suspended solids in a papermaking pulp stock flow stream.

2. Description of the Related Art

In the paper industry, paper is made from wood fibers and chemicals and they are transported from one part of the paper mill to the other in a liquid medium that consists primarily of water once in this liquid medium, the fibers can be treated with chemicals to change their properties and improve paper quality. For example, chemicals can be added to bleach the fibers white or to cause the fibers to acquire certain mechanical properties.

In order for the paper making process to operate efficiently, the ratio of the weight of solids (fibers and other suspended solids) to the total weight of the mixture (fibers and solids and liquids) . . . termed "consistency" must be measured and controlled. The term "suspended solids" is anything in a mixture that will remain after all the liquids have been drained and/or evaporated away. Wood fiber is in fact a suspended solid, but since it is the main ingredient used to make paper, we refer to it separately.

The mathematical equation for consistency is according to Equation 1:

$$\text{CONSISTENCY (\%)} = \frac{\text{dry weight of wood fibers} + \text{dry weight of other suspended solids}}{\text{total weight of the mixture}} \times 100.0 \quad \text{(Eq. 1)}$$

The accuracy of a consistency meter is checked by extracting a representative sample of the mixture the meter is measuring and applying the above Equation 1, using the weight of the sample mixture and the weight of what is left after all moisture has been removed and comparing the results to what the meter indicated the consistency was at the time the sample was extracted.

Consistency of pulp stock is typically controlled by diluting it with water as the stock is pumped from a storage tank to the next stage in the process. It is standard practice to introduce the dilution water just ahead of the stock pump to obtain good mixing. Obviously, the consistency of the stock leaving the storage tank must be higher than what is needed for the next stage of the process in order for this to work.

As shown in prior art FIG. 1, the most basic control strategy utilizes a single consistency meter 16 at the end of the process stage 12 and a consistency controller 10 to manipulate a dilution water valve 6 to maintain the desired consistency. As can be seen in FIG. 1, consistency control system 2 includes papermaking storage tank 4, dilution valve 6, stock pump 8, consistency controller 10, process stage 12, process additive lines 14 and consistency meter 16. Process stage 12 may, for example, be a bleaching stage with additive lines 14 being bleaching chemical lines.

A more involved control strategy, as shown in prior art FIG. 2, includes a dilution water flow meter 22 and flow controller 24 for dilution water flow control that receives its' flow setting (flow setpoint) from consistency controller 10.

This strategy accounts for fluctuations in the dilution water supply pressure. As can be seen in FIG. 2, consistency control system 20 includes storage tank 4, dilution valve 6, stock pump 8, consistency controller 10, process stage 12, process additive lines 14, consistency meter 16, dilution flow meter 22 and dilution flow controller 24.

As shown in prior art FIG. 3, even more involved control strategies have been used to bias (add or subtract a value to/from) the consistency controller's output 32 as additional liquids and/or suspended solids are introduced into the process so that dilution flow is adjusted accordingly. As can be seen in FIG. 3, consistency control system 30 includes storage tank 4, dilution valve 6, stock pump 8, consistency controller 10, process stage 12, process additive lines 14, consistency meter 16, dilution flow meter 22, dilution flow controller 24, and dilution setpoint 32.

It is also known that deadtime (measurement delay) is the biggest contributor to errors in process control, so it is important that the major sources of deadtime be identified and their contribution to total deadtime be reduced if possible. The most obvious and most significant cause of deadtime in the control of papermaking stock consistency results from the placement of the consistency measuring device (meter) with respect to the dilution water injection point, and until the present invention, significant deadtime was sometimes unavoidable.

For example, for processes requiring the introduction of liquids and/or suspended solids after the injection of dilution water, the consistency meter must be placed after the last addition point since that is where consistency ceases to change. This forces a significant delay (deadtime) between the time dilution water is injected and the resulting change in consistency is detected. The most advanced prior art control strategy outlined in FIG. 3 eliminates transport delays that would otherwise occur between the process additives and the consistency meter 22, but a significant transport delay still exists between the dilution water injection point and consistency meter 16.

There are many consistency meters on the market and the present invention is not limited to the use of any particular type. Instead, the present invention has to do with where to place a consistency meter in the papermaking process and how the virtual consistency meter's measurement is obtained. A virtual consistency meter is not a physical meter (one you can put your hands on), but instead a calculated consistency value that represents the consistency at the end of a particular stage in the paper making process after additional liquids and/or suspended solids have been introduced.

It is apparent from the above that there exists a need in the art for a consistency control system which can provide the control of consistency leaving a papermaking process stage with minimum deadtime (measurement delay). It is a purpose of this invention to fulfill these and other needs in the art in a manner more apparent to the skilled artisan once given the following disclosure.

SUMMARY OF THE INVENTION

Generally speaking, this invention fulfills these needs by providing a papermaking stock consistency control system, comprising a papermaking stock chest means, a conduit means operatively connected to the papermaking stock chest means, papermaking stock dilution means operatively connected to the conduit means, a papermaking stock pump means operatively connected to the conduit means, a papermaking stock consistency transmitter means operatively connected to the stock pump means, a papermaking stock flow measuring means operatively connected to the papermaking stock consistency transmitter means, a papermaking process stage means operatively connected to the papermaking stock flow measuring means, and a papermaking stock consistency controller means operatively connected to the papermaking stock dilution means, the papermaking stock consistency transmitter means, the papermaking stock flow measuring means, and the papermaking process stage means.

In certain preferred embodiments, the papermaking stock dilution means is an automatic control valve. Also, the consistency transmitters are microwave consistency transmitters and the papermaking stock flow measuring means is a magnetic flow meter. Finally, the process stage means is a bleaching stage.

The preferred papermaking stock consistency control system, according to this invention, offers the following advantages: lightness in weight; ease of assembly and repair; instantaneous response to flow changes; good mixing of the papermaking stock; better control of additives in the papermaking stock; less probability of measurement problems; good stability; good durability; good economy; and high strength for safety. In fact, in many of the preferred embodiments, these factors of instantaneous response to flow changes, good mixing, and better control of the additives in the papermaking stock, are optimized to an extent that is considerably higher than heretofore achieved in prior, known consistency control systems.

BRIEF DESCRIPTION OF THE DRAWING

The above and other features of the present invention, which will become more apparent as the description proceeds, are best understood by considering the following detailed description in conjunction with the accompanying drawings, wherein like characters represent like parts throughout the several views and in which.

DETAILED DESCRIPTION OF THE INVENTION

Figure 1:
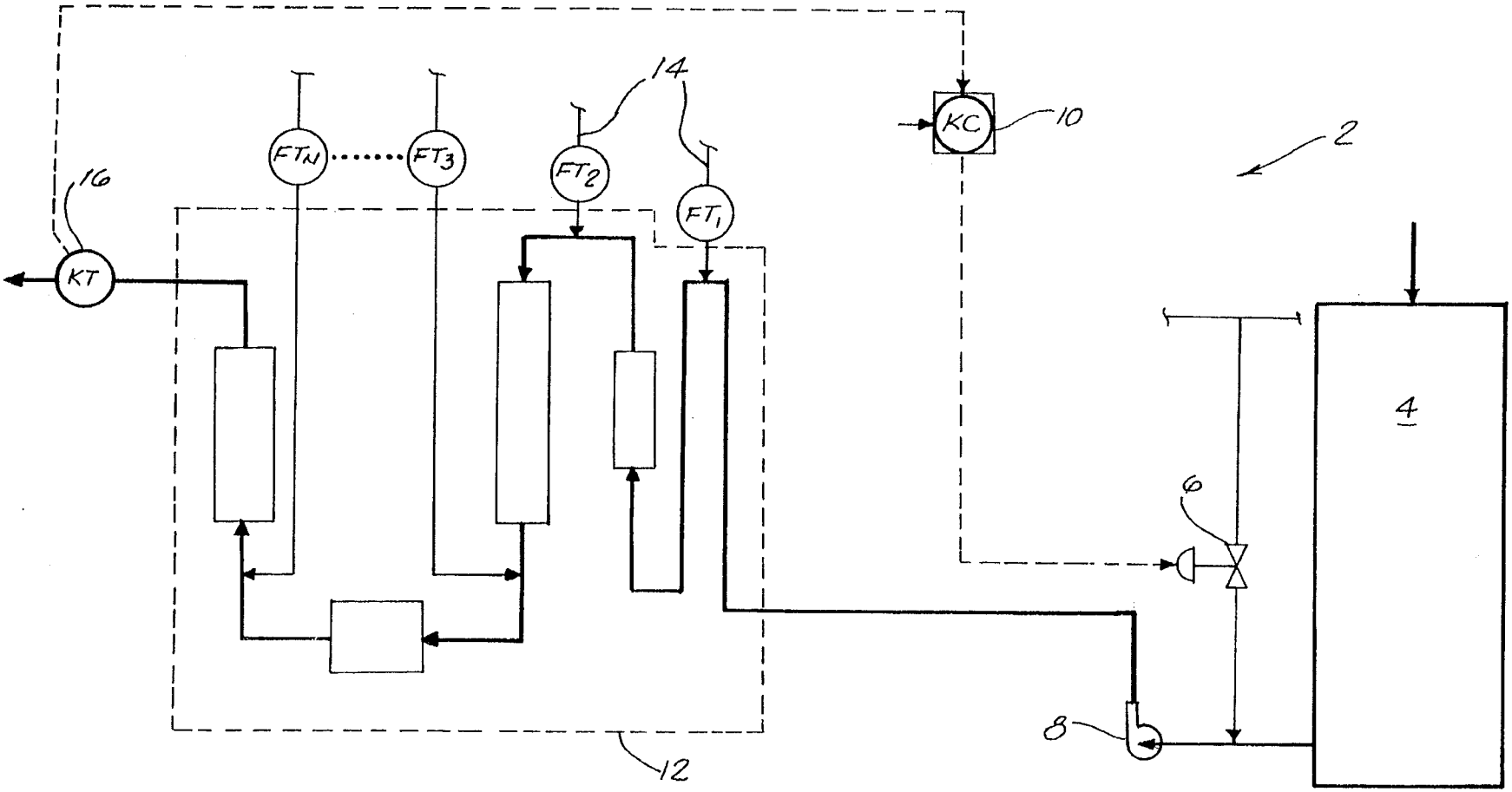
FIG. 1 PRIOR ART
FIG. 1 is a schematic illustration of a prior art papermaking stock consistency control system.
Figure 2:
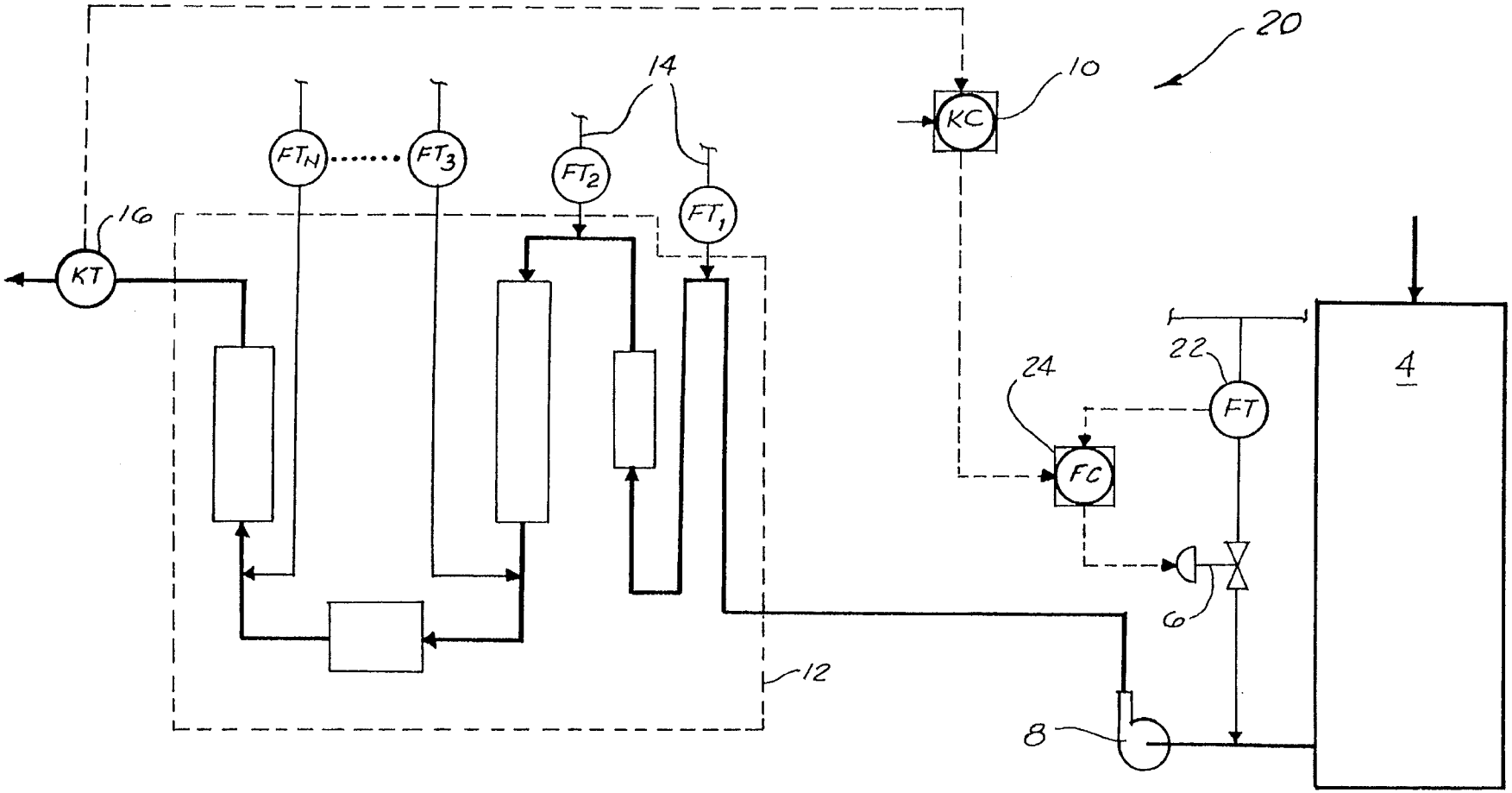
FIG. 2 PRIOR ART
FIG. 2 is a schematic illustration of another prior art papermaking stock consistency control system.
Figure 3:
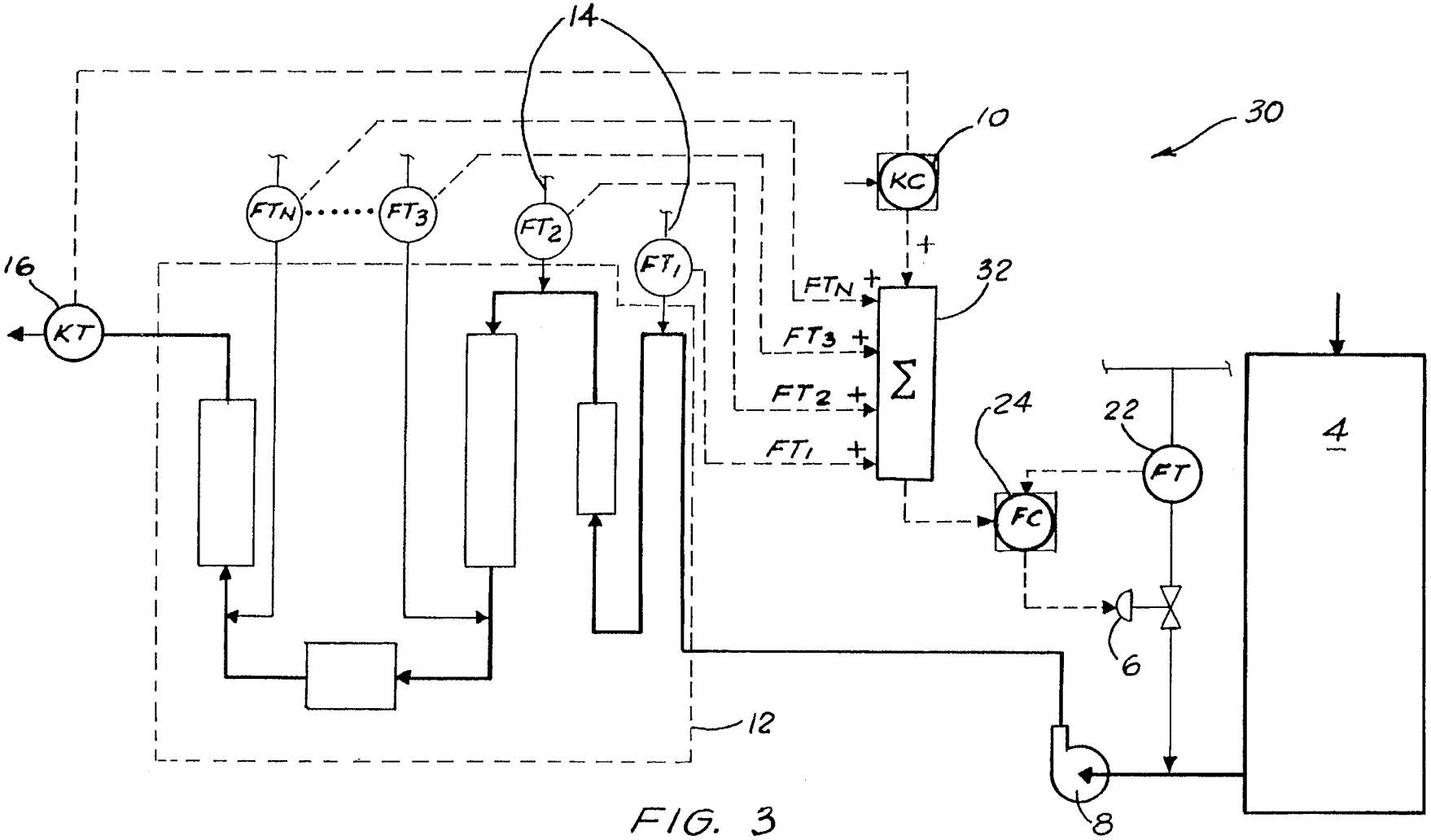
FIG. 3 PRIOR ART
FIG. 3 is a schematic illustration of a further prior art papermaking stock consistency control system.

As discussed earlier, FIGS. 1–3 schematically represent prior attempts at developing systems to control the consistency of papermaking stock leaving a process stage.

Figure 4:
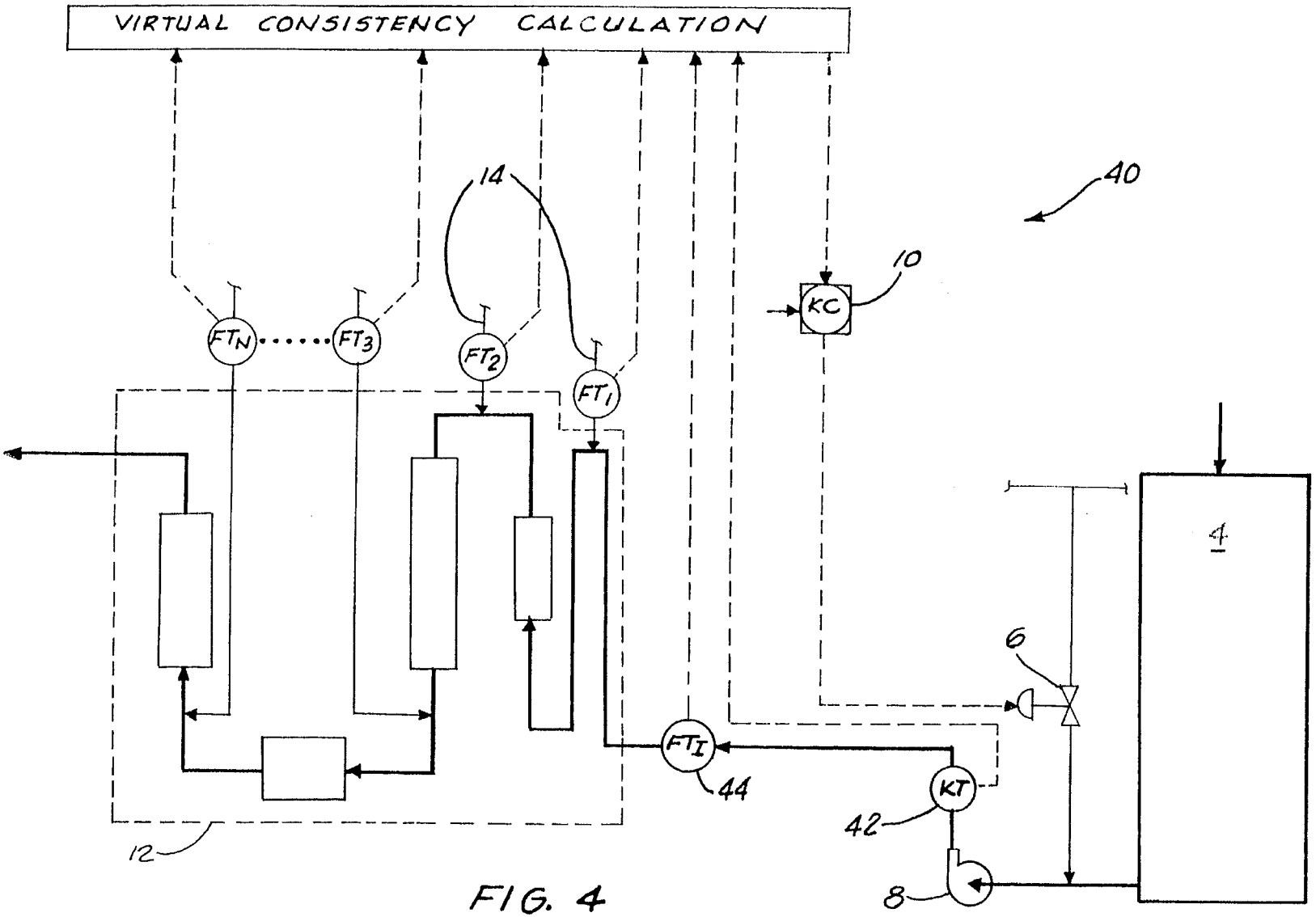
FIG. 4 is schematic illustration of a virtual papermaking stock consistency control system, according to the present invention.

With reference to the FIG. 4, there is illustrated a papermaking stock consistency control system 40. System 40 includes, in part, storage tank 4, automatic control valve 6, stock pump 8, consistency controller 10, process stage 12, process additive lines 14, conventional papermaking stock consistency meter 42 and conventional papermaking stock flow meter 44. Consistency controller 10, preferably, is a microprocessor based controller which is used to calculate downstream consistency control. Also, consistency meter 42, preferably, is a microwave consistency transmitter.

During the operation of papermaking stock consistency control system 40, papermaking stock from stock chest 4 is transported to pump 8 by conventional conduits. As discussed earlier, during the transportation of the stock from chest 4 to pump 8, it is desirable to measure the consistency of the papermaking stock. Consistency, particularly, being defined as a percentage of dry stock in the slurry. Depending upon the desired consistency of the stock, water from dilution valve 6 is used to correct the consistency to achieve the desired consistency.

After the stock reaches pump 8, the stock is then transported by conventional techniques through meter 42, flow meter 44 and process stage 12. In order to properly control the consistency of the stock exiting process stage 12, consistency meter 42, stock flow meter 44, consistency controller 10 and flows from process additive lines 14 are used to control the stock consistency according to the following Equation 2:

$$\text{Virtual Consistency} = \frac{\left[\frac{A}{100}\right] \times [B]}{B + C} \times 100 \qquad \text{(Eq. 2)}$$

where

A=stock consistency value from meter 42,

B=stock flow value from stock flow meter 44, and $C = FT_1 \cdot (S_g \text{ of } 1) + FT_2(S_g \text{ of } 2) + FT_3, (S_g \text{ of } 3) + \ldots FT_4(S_g \text{ of } N)$, where $S_s$=Specific Gravity of Liquid In short, meters 42 and 44, controller 10 and flows from process additive lines 14 determine whether or not water needs to be added to the stock prior to introduction into the pump 8.

The advantages of papermaking stock consistency control system 40 are that the virtual consistency measurement provides instantaneous response to flow changes, for example, process additive lines 14. Second, due to the fact that valve 6 is placed ahead of pump 8, this results in good mixing of the papermaking stock which is very important for high stock consistency. Third, meter 42 is placed near pump 8 where consistency measurement deadtime is minimized and, thus, a more precise control can be made. Fourth, meter 42 is placed before process stage 12 so that special, protective materials for meter 42 are not required. Fifth, the papermaking stock process additives can be more accurately supplied prior to process stage 12. Finally, there is less of a possibility of measurement problems due to inadvertent coating of the meter 42 with papermaking materials prior to the process stage 12.

It should also be noted that when necessary, the contribution of various additive flows to the final consistency (Virtual Consistency Measurement) can be modified to correct for differences in densities and/or suspended solids. For example, Equation 2 assumes that all ingredients (wood fibers, other suspended solids and liquids) have the same specific gravity (specific gravity=density of $H_2O$ divided by the density of an ingredient). If instead, the additive measured with flow meter $FT_1$ has a specific gravity of two (2) and 10% of the additive measured by meter $FT_3$ is suspended solids having a specific gravity of one (1) and all other additives having a specific gravity of one (1), the equation should be modified as shown below in Equation 3:

$$\text{Virtual Consistency (\%)} = \frac{(KT/100) \times FT_1 + (0.1 \times FT_3)}{FT_1 + (2.0 \times FT_1) + FT_2 + FT_3 + \ldots + FTN} \times 100.0 \quad \text{(Eq. 3)}$$

For simplicity, the use of a dilution flow control loop (as used in FIG. 2) is not shown, but could be added to improve the control of consistency if fluctuations in dilution water header pressure exists.

In short, the Virtual Consistency Meter of the present invention provides minimum deadtime between dilution water injection and the consistency measurement and it corrects for the addition of other liquids and/or suspended solids as their flow rates vary.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A papermaking stock consistency control system, wherein said consistency control system is comprised of:

a papermaking stock chest means;

a first conduit means connected at one end to said papermaking stock chest means;

a papermaking stock dilution means connected to said first conduit means;

a papermaking stock pump means attached at the other end of said first conduit means;

a papermaking stock consistency transmitter means connected to said stock pump means by a second conduit means;

a papermaking stock flow measuring means connected to said papermaking stock consistency transmitter means by a third conduit means;

a papermaking process stage means connected to said papermaking stock flow measuring means by a fourth conduit means;

a papermaking stock consistency controller means electrically connected to said papermaking stock dilution means, said papermaking stock consistency transmitter means, said papermaking stock flow measuring means, and said papermaking process stage means.

2. The consistency control system, as in claim 1, wherein said dilution means is further comprised of:

an automatic control valve.

3. The consistency control system, as in claim 1, wherein said papermaking stock consistency transmitter means is further comprised of:

a microwave consistency transmitter.

4. The consistency control system, as in claim 1, wherein said papermaking stock flow measuring means is further comprised of:

a magnetic flow meter.

5. The consistency control system, as in claim 1, wherein said papermaking process stage means is further comprised of:

a bleaching stage.

6. The consistency control system, as in claim 5, wherein said bleaching stage is further comprised of:

additive lines operatively connected to said papermaking stock consistency controller means.

7. The consistency control system, as in claim 1, wherein said papermaking stock consistency controller means is further comprised of:

a microprocessor based controller.

8. A method for controlling a papermaking stock consistency, wherein said method is comprised of the steps of:

determining a desired papermaking stock consistency value;

determining a papermaking stock consistency value from a papermaking stock consistency transmitter means;

determining a papermaking stock flow value from a papermaking stock flow measuring means;

determining a process stage additive flow value from a process stage additive flow measurement means;

calculating a virtual papermaking stock consistency value according to the equation:

$$\text{Virtual Consistency} = \frac{\left[\frac{A}{100}\right] \times [B]}{B + C} \times 100$$

where

A=papermaking stock consistency value

B=papermaking stock flow value, and

C=process stage additive flow value;

comparing said virtual papermaking stock consistency value with said desired papermaking stock consistency value; and adjusting, if necessary, said virtual papermaking stock consistency value.

* * * * *

UNITED STATES PATENT AND TRADEMARK OFFICE

CERTIFICATE OF CORRECTION

PATENT NO. : 5,611,891

DATED : Mar. 18, 1997

INVENTOR(S) : Raymond E. Hundley, III

It is certified that error appears in the above-indentified patent and that said Letters Patent is hereby corrected as shown below:

Col 1, Ln 18, after "water" insert --.--.

Col 1, Ln 18, delete "once" insert --Once--.

Col 4, Ln 29, after "$FT_2$" insert -- · --.

Col 4, Ln 29, after "$FT_3$" delete "," insert -- · --.

Col 4, Ln 29, change "$FT_4$" to --$FT_N$--.

Signed and Sealed this

Twentieth Day of May, 1997

*Attest:*

*Attesting Officer*

Bruce Lehman

BRUCE LEHMAN

*Commissioner of Patents and Trademarks*